US009260211B2

(12) United States Patent
Hung

(10) Patent No.: US 9,260,211 B2
(45) Date of Patent: Feb. 16, 2016

(54) PLASTIC FILM WRAPPING DEVICE

(71) Applicant: Tzu-Chin Hung, New Taipei (TW)

(72) Inventor: Tzu-Chin Hung, New Taipei (TW)

( * ) Notice: Subject to any disclaimer, the term of this patent is extended or adjusted under 35 U.S.C. 154(b) by 569 days.

(21) Appl. No.: 13/721,848

(22) Filed: Dec. 20, 2012

(65) Prior Publication Data

US 2014/0130451 A1 May 15, 2014

(30) Foreign Application Priority Data

Nov. 13, 2012 (TW) ..... 101221870 U

(51) Int. Cl.
*B65B 41/16* (2006.01)
*B65B 11/10* (2006.01)

(52) U.S. Cl.
CPC ..... *B65B 41/16* (2013.01); *B65B 11/10* (2013.01)

(58) Field of Classification Search
CPC ..... B65B 11/00; B65B 11/06; B65B 11/10; B65B 11/16; B65B 11/54; B65B 11/58; B65B 11/585
USPC ..... 53/586, 203, 209
See application file for complete search history.

(56) References Cited

U.S. PATENT DOCUMENTS

| | | | | |
|---|---|---|---|---|
| 5,193,328 | A * | 3/1993 | Boriani et al. | 53/466 |
| 5,850,723 | A * | 12/1998 | Kallfass | 53/442 |
| 9,003,744 | B2 * | 4/2015 | Hannen | 53/170 |
| 2006/0059863 | A1 * | 3/2006 | Michler et al. | 53/399 |
| 2006/0096244 | A1 * | 5/2006 | Cere' | 53/399 |
| 2014/0033657 | A1 * | 2/2014 | Cere' | 53/461 |

FOREIGN PATENT DOCUMENTS

| | | |
|---|---|---|
| TW | 260270 I | 8/2006 |
| TW | 326666 I | 7/2010 |

* cited by examiner

*Primary Examiner* — Andrew M Tecco
*Assistant Examiner* — Chelsea Stinson
(74) *Attorney, Agent, or Firm* — Rosenberg, Klein & Lee

(57) ABSTRACT

A plastic film wrapping device has a chassis, at least one conveyer device, pair of feeders, and enclosing device. The feeders supply plastic film from the two sides of the chassis. An enclosing device straddles between two sides of the conveyer device and has at least one pair of sealing blades that are reciprocally movable in a horizontal direction which forms a film sealing opening, whereby the inward movement of the two sealing blades into the film sealing opening combine with each other to fuse and on together ends of the plastic films. A leading edge of the article contacts and pulls forward the joined plastic films to have the plastic films wrapped around an outer circumference of the article and then the rear ends of the plastic films are fused to seal the article.

13 Claims, 11 Drawing Sheets

PLASTIC FILM WRAPPING DEVICE

BACKGROUND OF THE INVENTION

1. Field of the Invention

The present invention relates to a plastic film wrapping device, and in particular to a device that is applied to wrapping film around an outer circumference of an article to be package and comprises a conveyor device for conveying the article to be package and at least one pair of horizontally-opposing movable sealing blades to enable automatic wrapping and enclosing of film around the article to be packaged.

2. The Related Arts

Plastic films have been widely used in packaging foodstuffs. Particularly, for instant foods, such as meal box, cooked foodstuffs, and fruits, which are sold for immediate eating, plastic films or plastic envelopes are commonly used to cover the package case of the foodstuffs to serve as a measure for presenting product markings and advertisements and also function as a primary enclosure of the package case. However, the size and shape of the package cases of these foodstuffs named above are generally different from each other due to diversified needs for packaging and advertisement required by different product suppliers. Thus, the existing ways of covering the package cases of different sizes with the plastic wrappings are usually done manually or with wrapping machines specifically design for a given package case. Manually wrapping a plastic film or a plastic envelope over a package case requires increased human labor, working hours, and costs. The quality of wrappings made with plastic films or plastic envelope is hard to control and this leads to inconsistency of packaging quality. Using wrapping machines specifically designed for a given package case to wrap plastic film or plastic envelope over the package case can effectively improve the quality issue of manually wrapping plastic film or plastic envelope but such machines are often fit to wrapping of a single type or a few types of package cases having specific size and shape. Once the supply of package cases of such specific size and shape is no long available or the specifications of the package cases are modified, these machines are no longer useful. This is disadvantageous for the economic values of the product packaging.

Prior art documents in this field are known, such as Taiwan Patent Nos. 1260270 and 1326666, which disclose multiple-layer film structures for typical foodstuff package cases. These films are attached to the package case manually or by machines provided specifically for a given packaged article. In addition, such films do not completely enclose and seal the packaged article and consequently, the package article must be subjected to two processes of packaging, which respectively wraps an enclosing film around the packaged article and attaches the multiple-layered film to he package articles. A lot of human labor and working hours, and thus cost, are needed. This is disadvantageous for the economic values of the packaging industry.

SUMMARY OF THE INVENTION

The conventional ways of wrapping a plastic film or a plastic envelope over a package case are done either manually or with a specific wrapping machine and are thus only fit to wrapping operations applied to package cases of a singe size or a few models. In addition, wrapping the plastic film or plastic envelope around the package in these ways suffers great increases of human labor, working hours, and costs, as well as being hard to effect quality control. Further, for different package cases or different articles to be packaged, different packaging machines must be provided for such package cases or articles to be packaged. This is certainly uneconomic.

Thus, an object of the present invention is to provide a plastic film wrapping device, which comprises a chassis, at least one conveyer device, at least one pair of feeders, at least one enclosing device. The conveyer device is mounted on the chassis to convey a plurality of articles-to-be-packaged. The feeders are coupled to two sides of the chassis to each supply plastic film from the two sides of the chassis. The enclosing device straddles between the two sides f the conveyer device. The enclosing device comprises at least one pair of sealing blades that are reciprocally movable in horizontal direction. The sealing blades form therebetween a film sealing opening, whereby the inward movement of the two sealing blades into the film sealing opening make them combined with each other to fuse and joint together ends of the plastic films supplied from the two sides of the chassis by the two feeders in the film sealing opening and when a leading edge of one of the articles-to-be-packaged on the conveyor device passes through the film sealing opening between the two sealing blade, the leading edge of the article-to-be-packaged contact and pull forward the jointed plastic films to have the plastic films wrapped around an outer circumference of the article-to-be-packaged and then rear ends of the plastic films are fused to seal around the article-to-be-packaged by re-combination of the two sealing blades moved into the film sealing opening, so that the outer circumference of the article-to-be-packaged is wrapped and enclosed by the plastic films.

The effectiveness of the plastic film wrapping device according to the present invention is that by applying the feeders to supply plastic films from two sides of the chassis, the enclosing device can first fuses and joints the plastic films together, so that when an article-to-be-packaged is conveyed forward by the conveyer device to hit and pull forward the jointed plastic films, the plastic film automatically wraps around outer circumference of the article-to-be-packaged. Subsequently, the enclosing device is operated again to fuse, joint, and seal the plastic film at the rear side of the article-to-be-packaged so that the plastic films are precisely and securely wrapped around the outer circumference of the article-to-be-packaged at a desired location. No human labor is needed to wrap the plastic film around articles-to-be-packaged one by one. The present invention enables application to articles-to-be-packaged of various sizes and shapes without preparing packaging machine specifically designed for given articles-to-be-packaged. The packaging hours, labor, and costs for wrapping plastic film around articles-to-be-packaged can be greatly reduced and the package quality of wrapping plastic films around articles-to-be-packaged and economic value of industrial use can both be improved.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
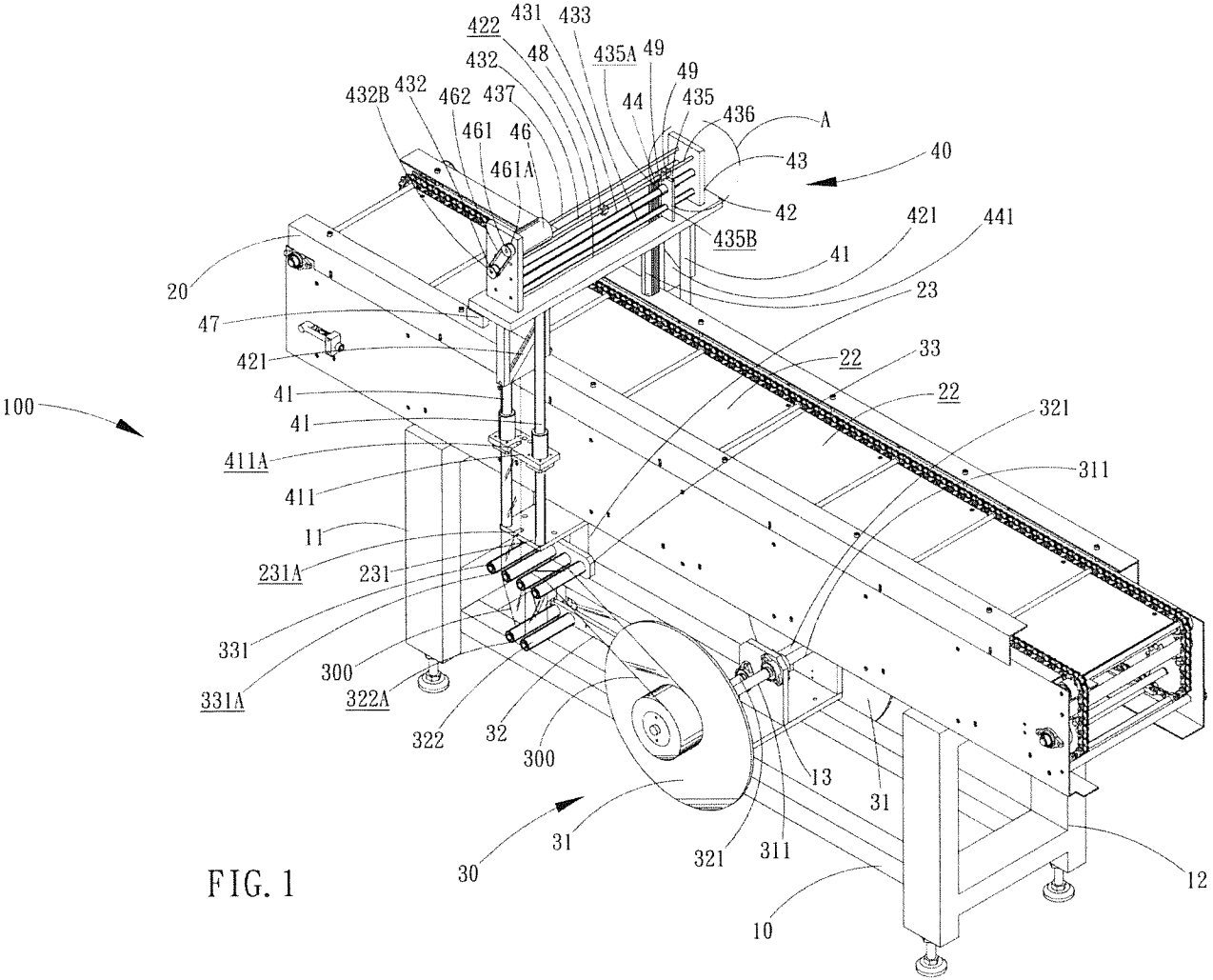
FIG. 1 is a perspective view showing a plastic film wrapping device according to a first embodiment of the present invention.
Figure 2:
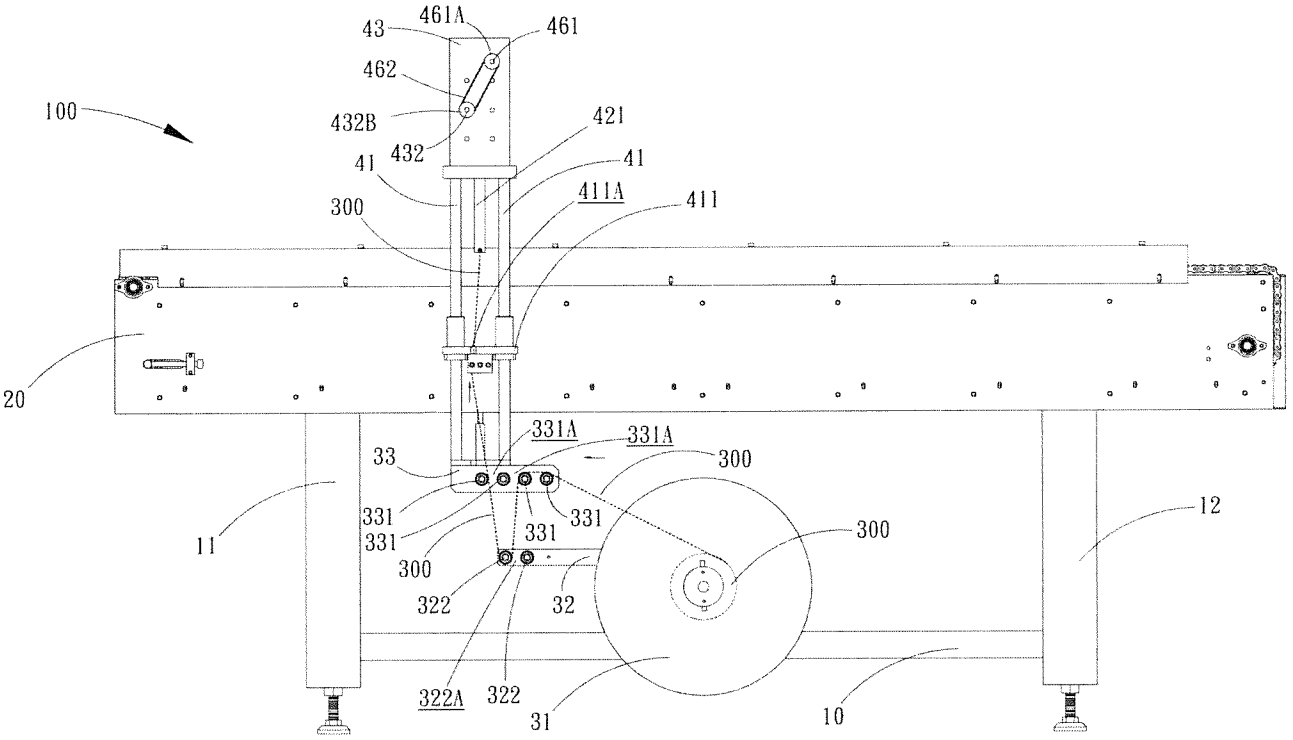
FIG. 2 is a side elevational view of the plastic film wrapping device according to the present invention.
Figure 3:
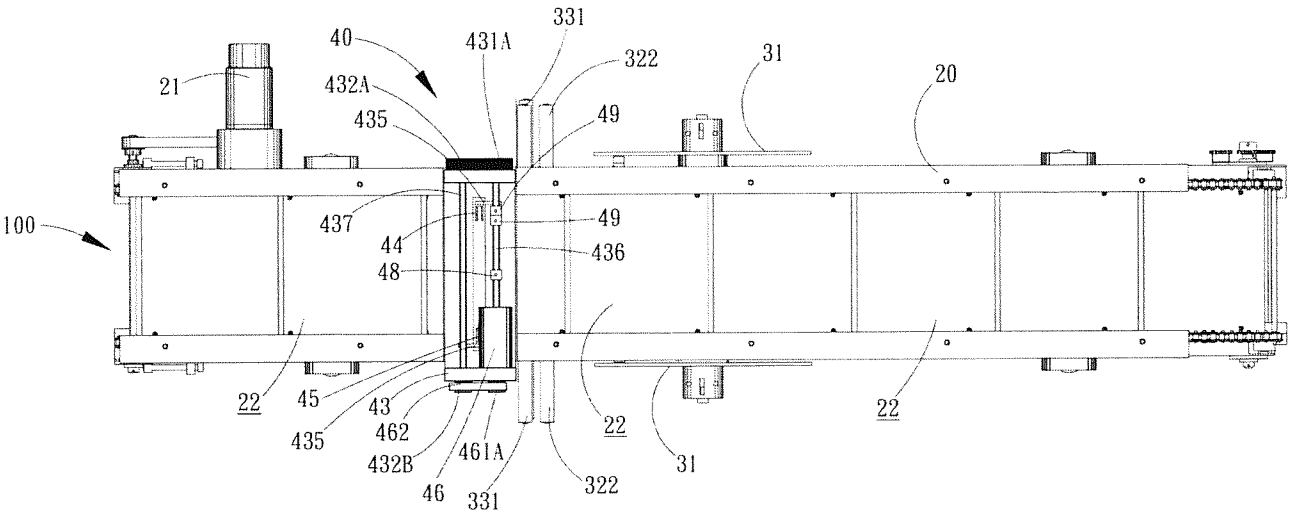
FIG. 3 is a top plan view of the plastic film wrapping device according to the present invention.
Figure 4:
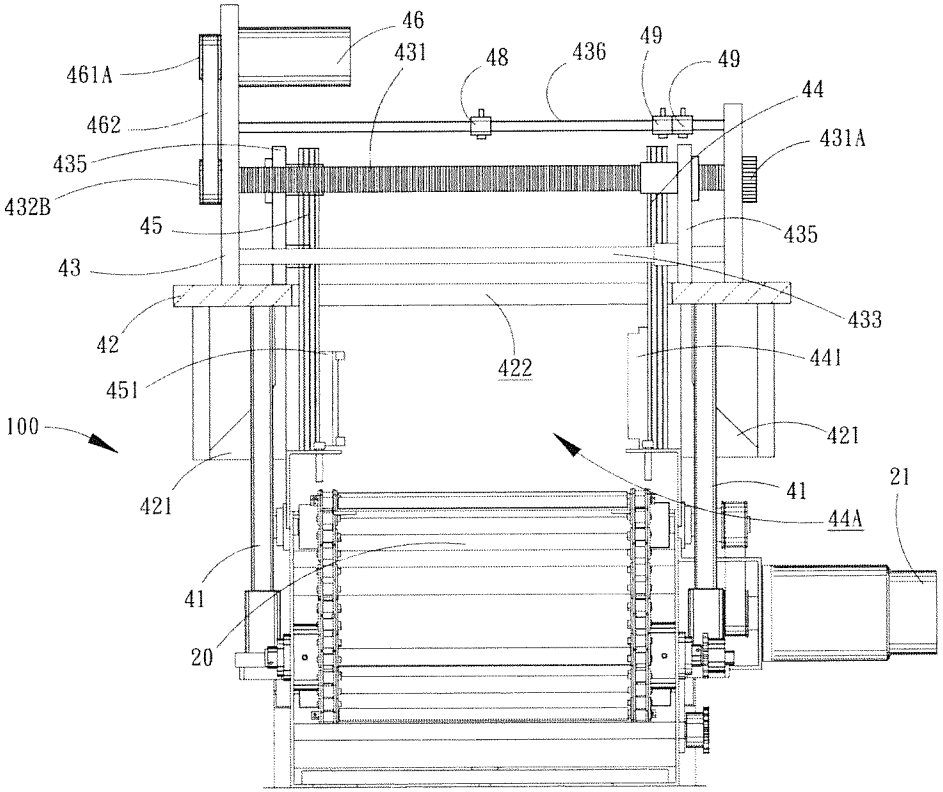
FIG. 4 is an enlarged front view, showing the structure of a conveyer device and an enclosing device of the plastic film wrapping device according to the present invention.

With reference to the drawings and in particular to FIGS. 1, 2, 3, and 4, a plastic film wrapping device constructed in accordance with a first embodiment of the present invention, generally designated at 100, is shown, wherein the plastic film wrapping device 100 comprises a chassis 10 having front end rear ends that are each provided with a support section 11, 12. At least one connection section 13 is arranged at bottom of the chassis 10 between the support sections 11, 12.

At least one conveyer device 20 is mounted on the two support sections 11, 12 of the chassis 10. The conveyer device 20 is driven by a motor 21 to do one-way linear circulating conveyance movement. The conveyer device 20 forms a plurality of spaced receptacle zones 22. Each of the receptacle zones 22 can receive an article-to-be-packaged 200 therein so that the conveyer device 20 may convey the articles-to-be-packaged 200 one by one along a one-way linear path. The conveyer device 20 comprises a connection seat 23 arranged at the bottom thereof. The connection seat 23 has two sides each forming a connection surface 231. The connection surface 231 forms at least one guide hole 231A.

At least one pair of feeders 30 is mounted to two sides of the connection section 13 of the chassis 10. The feeders 30 are not limited to any specific type and may each comprise, in an example of the present invention, a winding disk 31, a tension regulation arm 32, and a rotation shaft set 33, wherein the winding disk 31 has an end to which an axle 311 is mounted. The axle 311 has an end rotatably mounted to the connection section 13 at the bottom of the chassis 10. The winding disk 31 receives a roll of plastic film 300 wound thereon in such a way that an end of the plastic film 300 can be unwound from the winding disk 31. The tension regulation arm 32 has two ends respectively provided with an axle 321 and at least one pair of rotation axles 322. The axle 321 has an end rotatably mounted to one side of the connection section 13 at the bottom of the chassis 10 so as to enable the tension regulation arm 32 to swing up and down with the axle 321 as a rotation axis. The rotation axles 322 at one end of the tension regulation arm 32 form a gap 322A therebetween. The rotation shaft set 33 is mounted to one side of the connection surface 231 of each side of the connection seat 23 at the bottom of the conveyer device 20. The rotation shaft set 33 comprises rotation shafts 331 that form a plurality of gaps 331A therebetween. The gaps 331A and the gap 322A between the rotation axles 322 at one end of the tension regulation arm 32 respectively receive an end of the plastic film 300 from the winding disk 31 to extend therethrough and wind around the rotation axles 322 at one end of the tension regulation arm 32 and the rotation shafts 331 of the rotation shaft set 33 to have the end of the plastic film 300 finally extend out through one of the gaps 331A of the rotation shaft set 33 to be subsequently received into the guide hole 231A in the connection surface 231 of each side of the connection seat 23 at the bottom of the conveyer device 20.

Figure 5:
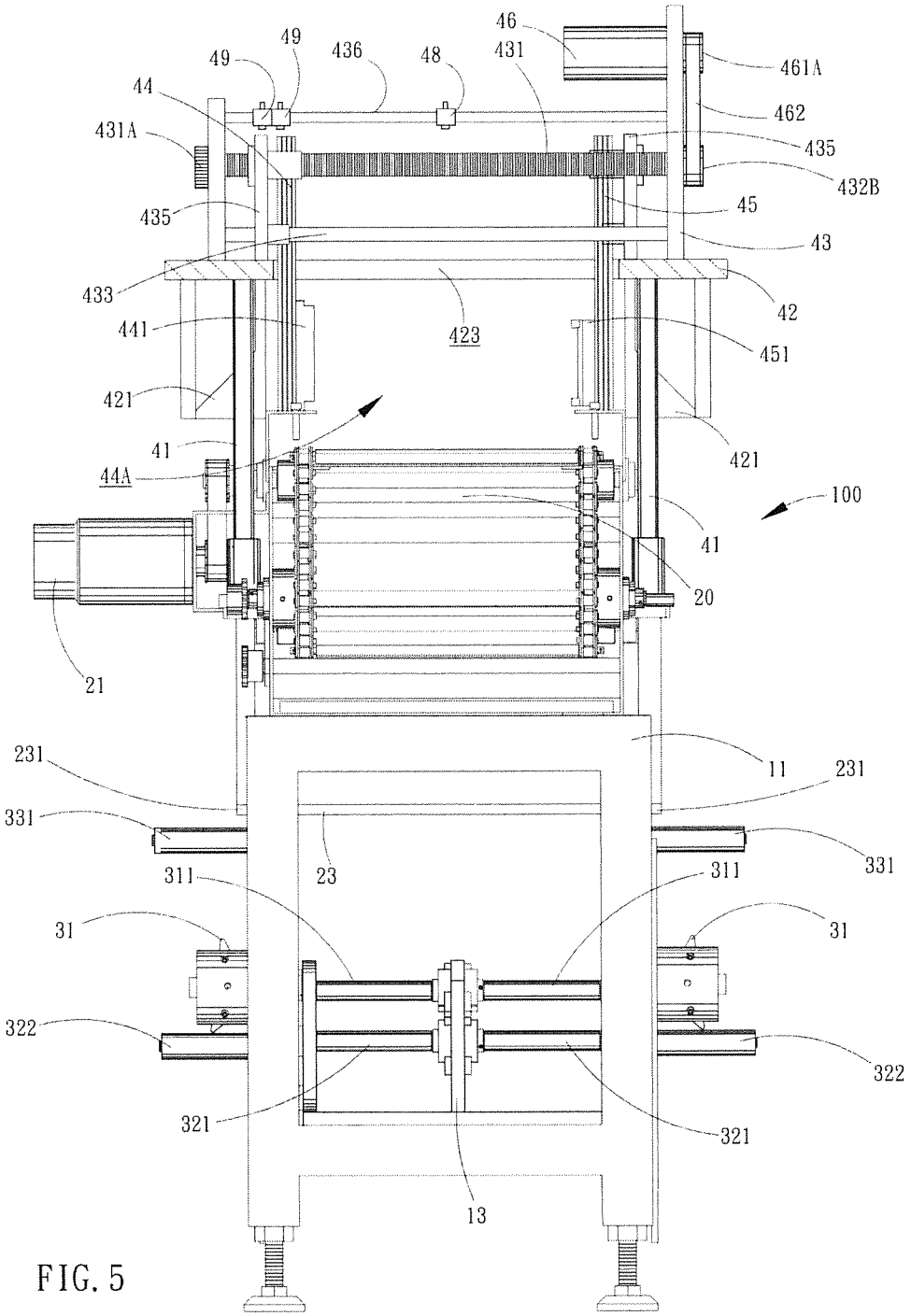
FIG. 5 is a rear view of the plastic film wrapping device according to the present invention.
Figure 6:
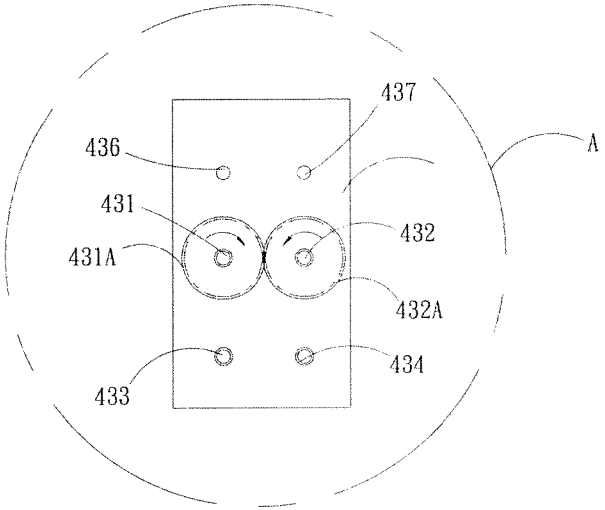
FIG. 6 is an enlarged side view of the circled portion A of FIG. 1.

Referring to FIGS. 5 and 6, at least one enclosing device 40 is provided straddling two sides of the conveyer device 20. The enclosing device 40 is not limited to any specific type and may comprises, in an example of the present invention, at least two pairs of support frame assemblies 41, a base 42, a rail unit 43, at least one pair of sealing blades 44, 45, a driving motor 46, a first detection unit 47, a second detection unit 48, and a pair of third detection units 49, wherein the support frame assemblies 41 have an end connected to the connection surface 231 of each side of the connection seat 23 at the bottom of the conveyer device 20. Each of the support frame assemblies 41 has a middle section that is provided with a guide seat 411. The guide seat 411 forms at least one through hole 411A to receive the end of the plastic film 300 that extends through the guide hole 231A of the connection surface 231 of each side of the connection seat 23 at the bottom of the conveyer device 20.

The base 42 has a bottom having two sides each connected between ends of each pair of the support frame assemblies 41, which are the ends of the support frame assemblies 41 that are not connected to the connection surface 231 of each side of the connection seat 23 at the bottom of the conveyer device 20. The bottom of the base 42 is provided, at each side thereof, with a direction changer 421. The direction changer 421 is not limited to any specific type and a triangular bracket is taken as an example in the present invention, which allows the end of the plastic film 300 that extends through the through hole 411A of the guide seat 411 of the support frame assemblies 41 to wind around the direction changer 421 to make a 90-degree turn, namely being changed from a vertical direction outboard the base 42 into a horizontal direction inboard the base 42. The base 42 has a surface forming a first elongate slot 422 and a second elongate slot 423 (see FIG. 5).

The rail unit 43 is mounted atop the base 42. The rail unit 43 comprises at least one pair of first screw rod 431 and second screw rod 432, at least one pair of first rail 433 and second rail 434, at least one pair of movable seats 435, and at least one pair of first ancillary rail 436 and second ancillary rail 437, wherein the first screw rod 431 and the first rail 433, as well as the second screw rod 432 and the second rail 434, are arranged in pair in vertical arrangement. The first screw rod 431 and the first rail 433 are arranged in pair at the front side of the rail unit 43, while the second screw rod 432 and the second rail 434 are arranged in pair at the rear side of the rail unit 43. The first screw rod 431 has an end to which a first gear 431A is mounted. The second screw rod 432 has two ends to which a second gear 432A and a transmission roller 432B are respectively mounted. The second gear 432A mates the first gear 431A at one end of the first screw rod 431 (see FIG. 6), whereby the first screw rod 431 and the second screw rod 432 are coupled to each other for rotation in opposite directions.

The movable seats 435 each have upper and lower ends respectively forming a threaded hole 435A and a hole 435B that respectively receive the paired first screw rod 431 and first rail 433 and the paired second screw rod 432 and second rail 434 to extend therethrough, whereby the two movable seats 435 are driven by the clockwise or counterclockwise rotation of the first screw rod 431 and the second screw rod 432 to do linear movement toward outside or inside of the rail unit 43.

The first ancillary rail 436 is arranged above the first screw rod 431 and the second ancillary rail 437 is arranged above the second screw rod 432.

The sealing blades 44, 45 each have a lower end forming a sealing section 441, 451. The sealing sections 441, 451 respectively extend through the first elongate slot 422 and the second elongate slot 423 of the base 42. The sealing section 441, 451 uses electrical heating fusion to fuse and seal the plastic film 300. The sealing section 441 of the sealing blade 44 and the sealing section 451 of the sealing blade 45 form therebetween a film sealing opening 44A. The sealing blades 44, 45 have upper ends respectively coupled to the two movable seats 435, whereby the two sealing blades 44, 45 are movable in unison with the movable seats 435 to do linear movement along the first elongate slot 422 and the second elongate slot 423 of the base 42.

The driving motor 46 is arranged above the first ancillary rail 436 and the second ancillary rail 437 of the rail unit 43. The driving motor 46 has a spindle 461 coupled to a roller 461A. The roller 461A is coupled by a belt 462 to the transmission roller 432B at one end of the second screw rod 432 of the rail unit 43, whereby the second screw rod 432 of the rail unit 43 is driven by clockwise or counterclockwise rotation of the spindle 461 of the driving motor 46 to rotate.

The first detection unit 47 is arranged at one side of the conveyer device 20 behind the enclosing device 40 to detect a leading edge of an article-to-be-packaged 200 conveyed by the conveyer device 20 in order to activate the driving motor 46 to output rotary power.

The second detection unit 48 is mounted to the first ancillary rail 436 of the rail unit 43 to detect an extreme position where the movable seat 435 that is connected to the first screw rod 431 and the first rail 433 moves to the inner side of the rail unit 43 and controls the driving motor 46 to cut off the supply of rotary power in for example of clockwise direction to the second screw rod 432 of the rail unit 43 and also have the driving motor 46 to supply rotary power in an opposite direction, such as counterclockwise direction, to the second screw rod 432 so as to prevent the two movable seats 435 from further movement to the inner side of the rail unit 43 and instead, moving toward an outer side of the rail unit 43.

The two third detection units 49, are mounted to one end portion of the first ancillary rails 436 of the rail unit 43 to detect the extreme position of the movable seat 435 that is connected to the first screw rod 431 and the first rail 433 moving toward the outer side of the rail unit 43, so as to impose a limitation to the movement of the movable seat 435 toward the outer side of the rail unit 43, whereby when the movable seat 435 reaches an outer extreme position of the rail unit 43 set by the two third detection units 49, the driving motor 46 is controlled to cut off the supply of rotary power in for example the counterclockwise direction to the second screw rod 432 of the rail unit 43 to have the two movable seats 435 stopping at the outer extreme position of the rail unit 43.

Figure 7:
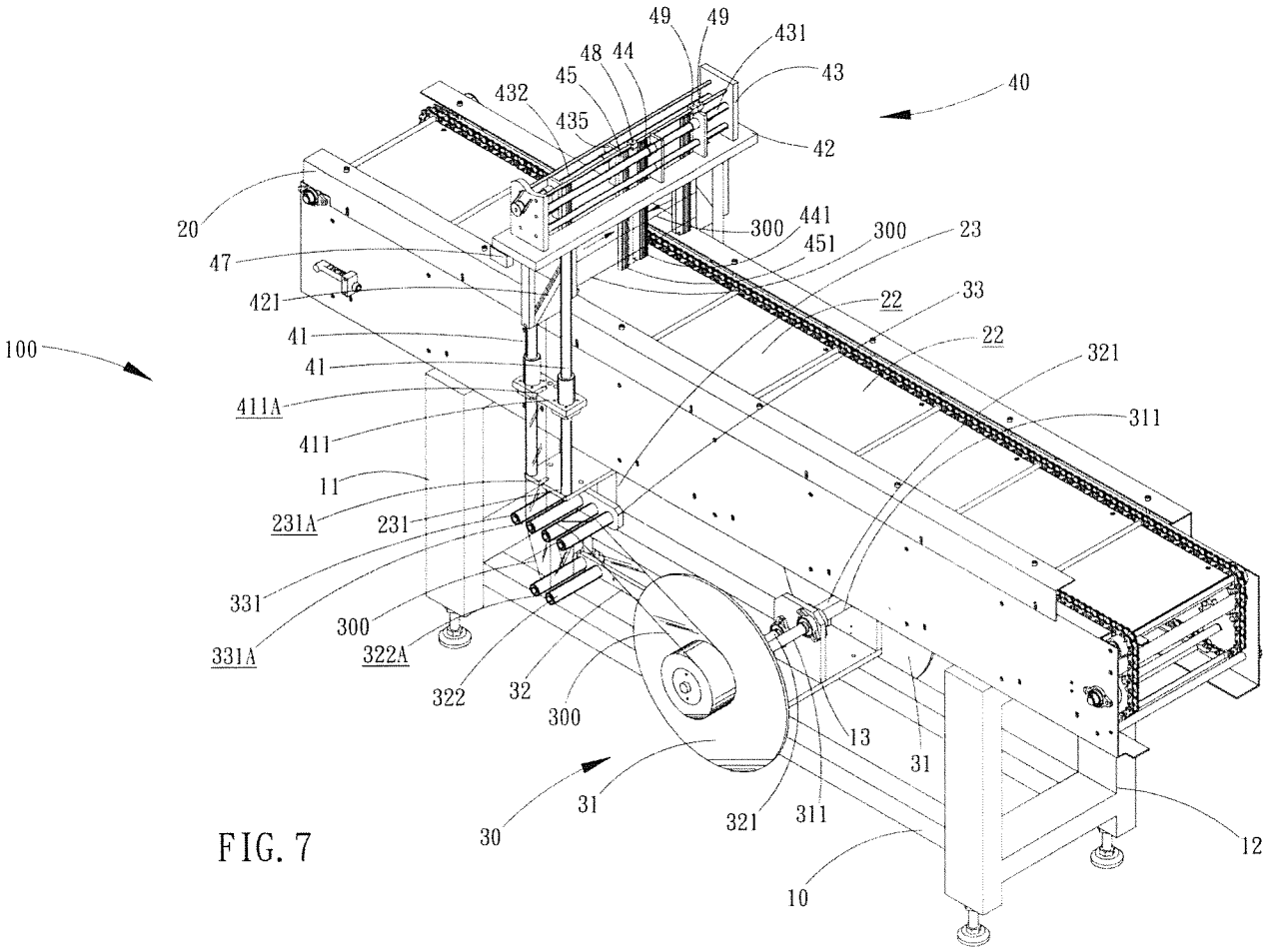
FIG. 7 is a schematic view showing an example of application of the plastic film wrapping device according to the present invention.
Figure 8:
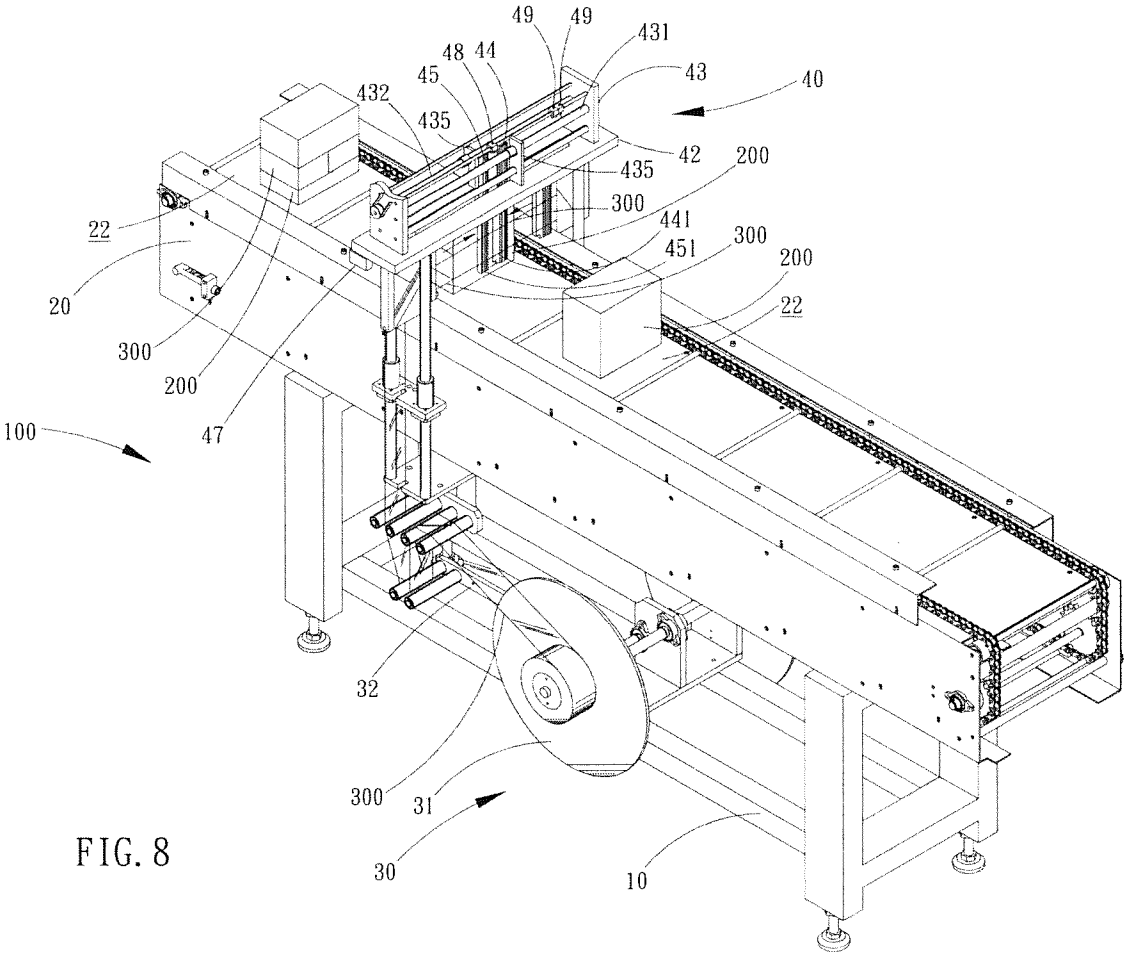
FIG. 8 is a perspective view illustrating a condition where an enclosing device of the plastic film wrapping device according to the present invention wrapping a plastic film around an article-to-be-packaged on a conveyer device.
Figure 9:
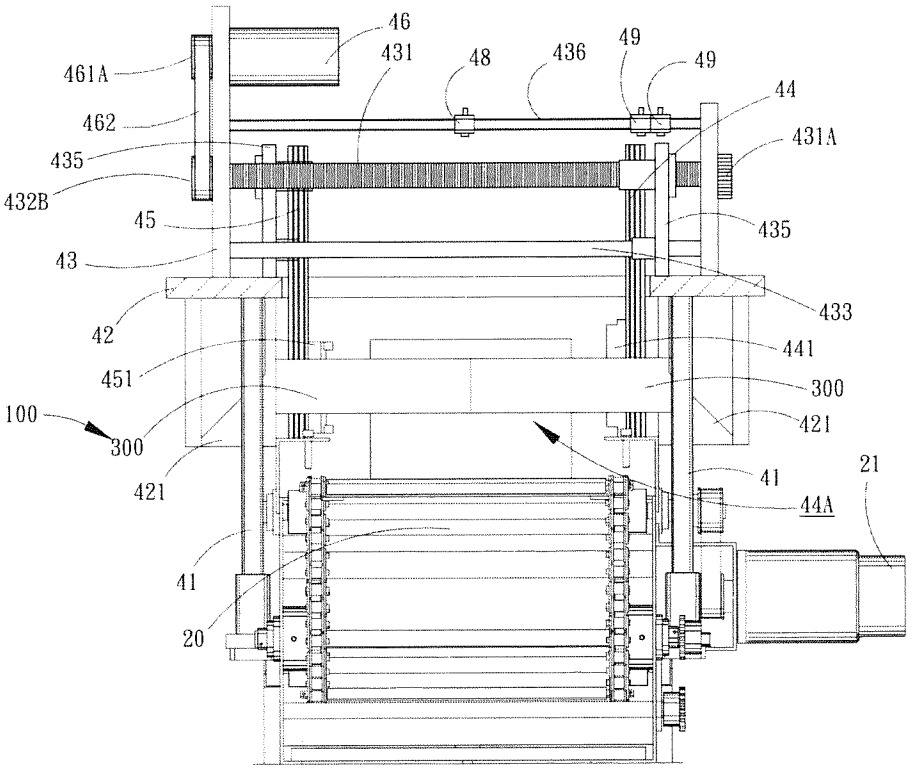
FIG. 9 is an enlarged front view illustrating a condition where sealing blades of the enclosing device of the plastic film wrapping device according the present invention fuse and seal plastic film at rear side of the article-to-be-packaged.

Referring to FIGS. 7, 8, and 9, an example of application of the plastic film wrapping device 100 according to the present invention is shown, wherein FIG. 7 shows that an end of the plastic film 300 on each of the two feeders 30 is conducted by the direction changer 421 at each side of the bottom of the base 42 of the enclosing device 40 into and overlapping in the film sealing opening 44A between the two sealing blades 44, 45. Then, the driving motor 46 of the enclosing device 40 supplies clockwise rotary power to the second screw rod 432 to have the two movable seats 435 respectively driving the sealing blades 44, 45 into the film sealing opening 44A to undergo linear displacement for combining each other. Such an operation can be activated by having a hand or an article blocking and activating the first detection unit 47 or by other measures so as to start up the driving motor 46. When the sealing sections 441, 451 at the lower ends of the two sealing blades 44, 45 mate each other at the overlapped end of the two plastic films 300, the two plastic films 300 are combined together as a unitary (as shown in FIG. 7). The sealing blades 44, 45 are then moved in such a way that the sealing blades 44, 45 are driven by the two movable seats 45 to move reversely back to the original positions outside the film sealing opening 44A, because the second detection unit 48 detects the movable seats 435 reach the inside extreme position of the rail unit 43 and the driving motor 46 is caused to supply a rotary power of counterclockwise direction to the second screw rod 432.

When and article-to-be-packaged 200 in the receptacle zones 22 of the conveyer device 20 passes through the film sealing opening 44A with a leading edge thereof contacting the plastic film 300, the plastic film 300 is impinged by the leading edge of the article-to-be-packaged 200 in a condition where the article-to-be-packaged 200 is still being conveyed forward by the conveyer device 20, the plastic film 300 is thus forcibly pulled to wrap around the outer circumference of the article-to-be-packaged 200. The plastic films 300 are stretched by the tension regulation arms 32 of the two feeders 30 so as to maintain in a stretched and tensioned condition.

When the leading edge of the article-to-be-packaged 200 reaches the position of the first detection unit 47 of the enclosing device 40, the driving motor 46 supplies clockwise rotary power to the second screw rod 432 of the rail unit 43 to have the two movable seats 435 re-driving the sealing blades 44, 45 to move from outside the film sealing opening 44A into the interior thereof to combine with each other so as to the portions of the plastic films 300 that are located rearward of the article-to-be-packaged 200 fused and sealed together (see FIG. 9), whereby the plastic films 300 completely enclose the outer circumference of the article-to-be-packaged 200. The remaining portions of the plastic film 300 that are located in the film sealing opening 44A are kept in a connected condition, whereby when the leading edge of the next article-to-be-packaged 200 on the conveyer device 20 passes through the film sealing opening 44A and hit the plastic films 300 again, the above described packaging operation and process are repeated to wrap the plastic films 300 around the article-to-be-packaged 200.

Figure 10:
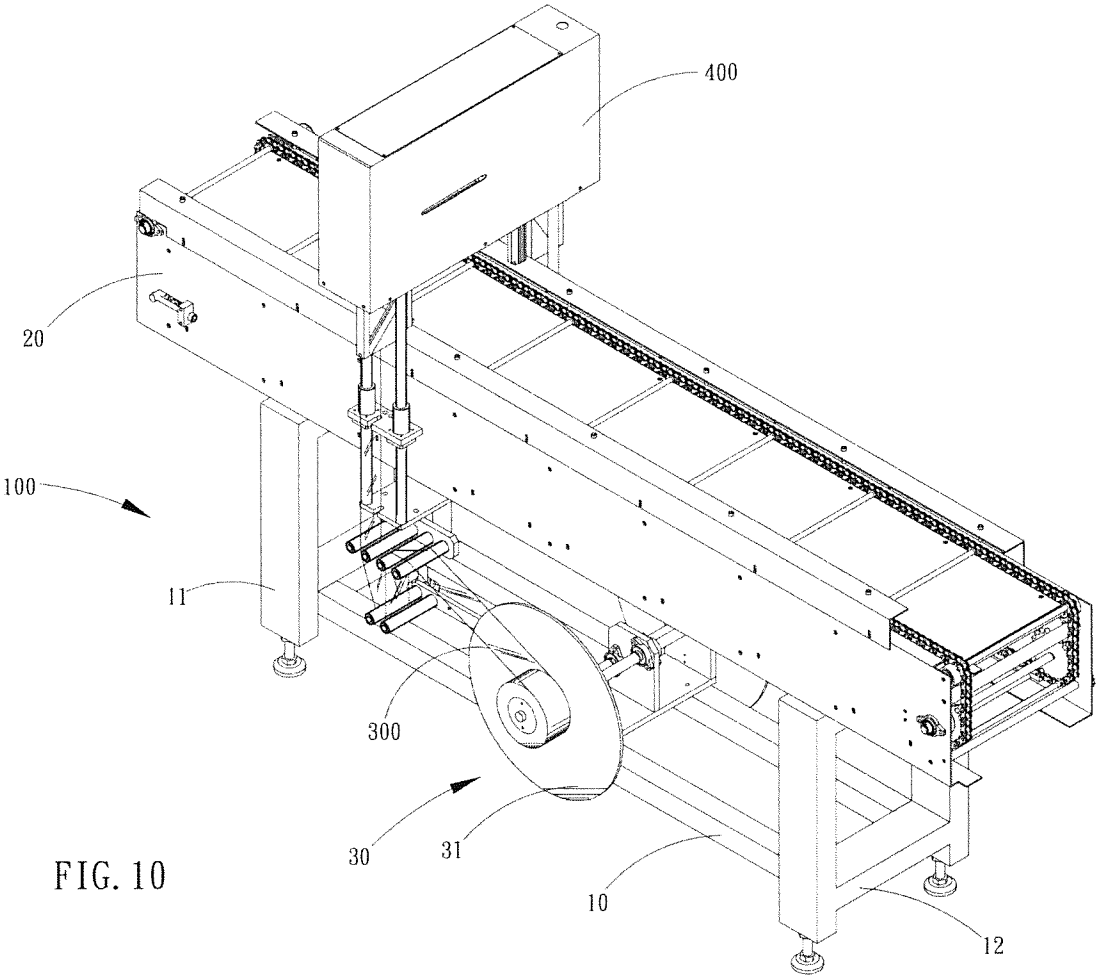
FIG. 10 illustrates a plastic film wrapping device according to a second embodiment of the present invention.

Referring to FIG. 10, a plastic film wrapping device according to a second embodiment of the present invention, also designated at 100, is shown, wherein a controller 400 is arranged above the rail unit 43 of the enclosing device 40. The controller 400 is provided to integrate the operations of detection and control of the first detection unit 47, the second detection unit 48 and the third detection units 49 and the driving motor 46 of the enclosing device 40. The controller 400 can be a programmable logic controller (PLC) or other packaging control circuit.

Figure 11:
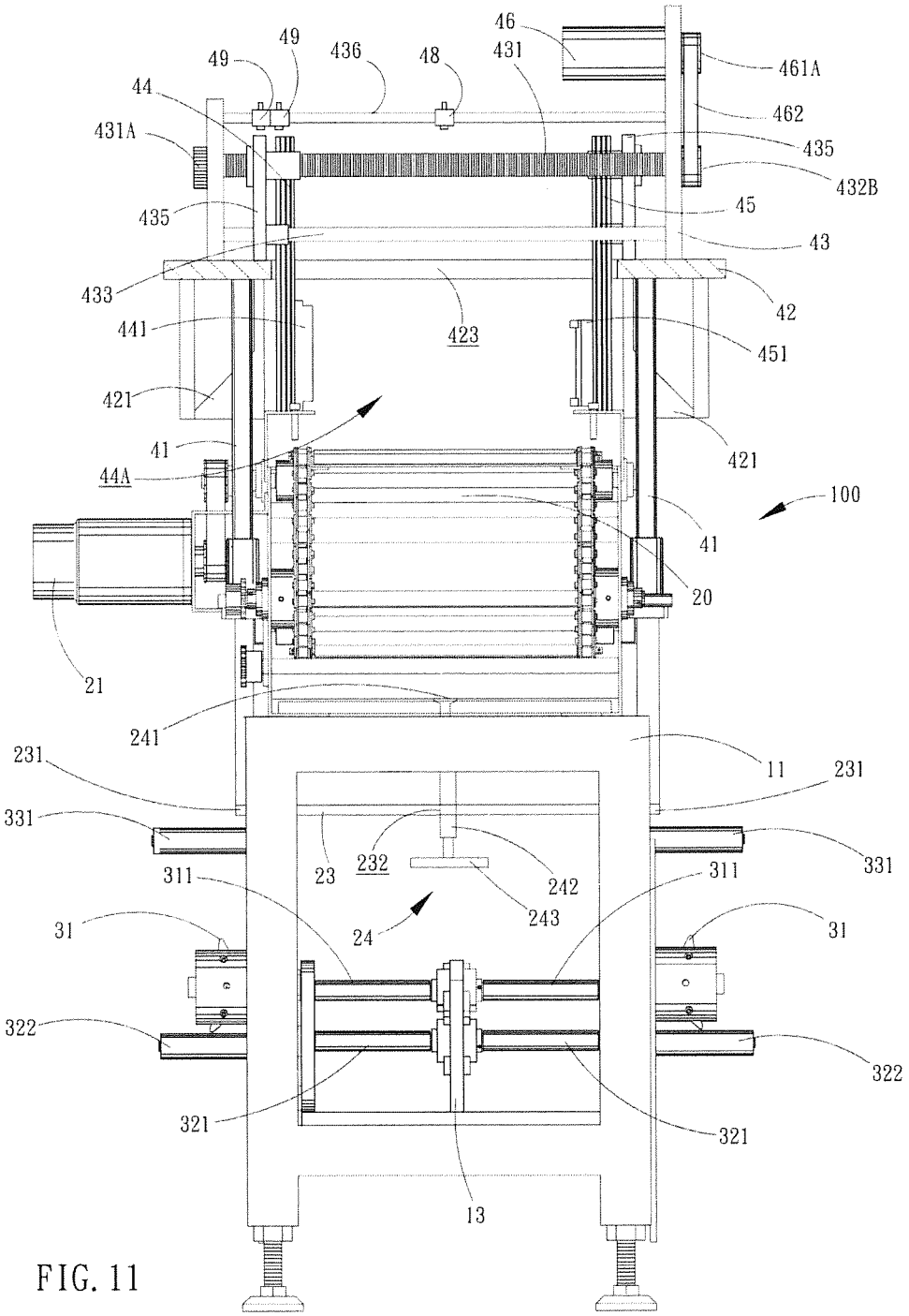
FIG. 11 illustrates a plastic film wrapping device according to a third embodiment of the present invention n.

Referring to FIG. 11, a plastic film wrapping device according to a third embodiment of the present invention, also designated at 100, is shown, wherein the connection seat 23 on the bottom of the conveyer device 20 comprises a height adjusting device 24 mounted thereon. The height adjusting device 24 comprises at least one bearing seat 241, a screw rod 242, and a roller 243. The connection seat 23 forms at least one threaded hole 232. The bearing seat 241 is mounted to the bottom of the conveyer device 20. The screw rod 242 has an end extending through the threaded hole 232 of the connection seat 23 to couple to the bearing seat 241. The roller 243 is mounted to an opposite end of the screw rod 241, whereby the rotation of the roller 243, either clockwise or counterclockwise, causes the connection seat 23 to move vertically and linearly along the screw rod 232 so as to effect height adjustment of the enclosed site of the plastic film 300 on the article-to-be-packaged 200.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A plastic film wrapping device, comprising:

a chassis;

at least one conveyer device, which is mounted on the chassis and is adapted to convey a plurality of articles-to-be-packaged;

at least one pair of feeders, which are respectively coupled to two sides of the chassis, each of the feeders comprising a roll of plastic film wound thereon in order to supply plastic films from the two sides of the chassis; and at least one enclosing device, which straddles between opposite sides of the conveyer device, the enclosing device comprising at least one pair of sealing blades that are reciprocally movable inward and outward in horizontal direction, the sealing blades forming therebetween a film sealing opening, whereby the inward movement of the two sealing blades into the film sealing opening make them combined with each other to fuse and joint together ends of the plastic films supplied from the two sides of the chassis by the two feeders in the film sealing opening and when a leading edge of one of the articles-to-be-packaged on the conveyor device passes through the film sealing opening between the two sealing blades, the leading edge of the article-to-be-packaged contacts and pulls forward the jointed plastic films to have the plastic films wrapped around an outer circumference of the article-to-be-packaged and then rear ends of the plastic films are fused to seal around the article-to-be-packaged by re-combination of the two sealing blades moved into the film sealing opening, so that the outer circumference of the article-to-be-packaged is wrapped and enclosed by the plastic films;

wherein the conveyer device comprises a connection seat arranged at the bottom thereof, the connection seat having two sides each forming a connection surface, the connection surfaces supporting the enclosing device therebetween;

the connection seat on the bottom of the conveyer device comprises a height adjusting device mounted thereon;

the connection seat forming at least one threaded hole, the height adjusting device comprising:

at least one bearing seat, which is mounted to the bottom of the conveyer device;

at least one screw rod, which has an end extending through the threaded hole of the connection seat to couple to the bearing seat; and at least one roller, which is mounted to an opposite end of the screw rod, whereby the rotation of the roller in clockwise or counterclockwise direction, causes the connection seat to move vertically and linearly along the screw rod.

2. The plastic film wrapping device as claimed in claim 1, wherein the chassis having front and rear ends each being provided with a support section, the conveyer device being mounted on the two support sections.

3. The plastic film wrapping device as claimed in claim 2, wherein at least one connection section is arranged at the bottom of the chassis between the support sections.

4. The plastic film wrapping device as claimed in claim 1, wherein, the conveyer device forms a plurality of spaced receptacle zones, each of which is adapted to receive one of the articles-to-be-packaged therein.

5. A plastic film wrapping device, comprising:

a chassis;

at least one conveyer device, which is mounted on the chassis and is adapted to convey a plurality of articles-to-be-packaged;

at least one pair of feeders, which are respectively coupled to two sides of the chassis, each of the feeders comprising a roll of plastic film wound thereon in order to supply plastic films from the two sides of the chassis; and at least one enclosing device, which straddles between opposite sides of the conveyer device, the enclosing device comprising at least one pair of sealing blades that are reciprocally movable inward and outward in horizontal direction, the sealing blades forming therebetween a film sealing opening, whereby the inward movement of the two sealing blades into the film sealing opening make them combined with each other to fuse and joint together ends of the plastic films supplied from the two sides of the chassis by the two feeders in the film sealing opening and when a leading edge of one of the articles-to-be-packaged on the conveyor device passes through the film sealing opening between the two sealing blades, the leading edge of the article-to-be-packaged contacts and pulls forward the jointed plastic films to have the plastic films wrapped around an outer circumference of the article-to-be-packaged and then rear ends of the plastic films are fused to seal around the article-to-be-packaged by re-combination of the two sealing blades moved into the film sealing opening, so that the outer circumference of the article-to-be-packaged is wrapped and enclosed by the plastic films;

wherein the chassis comprises at least one connection section arranged at bottom thereof, the conveyer device comprising a connection seat arranged at bottom thereof, the connection seat having two sides each forming a connection surface, each of the connection surfaces forming at least one guide hole, each of the feeders comprising:

a winding disk, which has an end to which an axle is mounted, the axle having an end rotatably mounted to the connection section at the bottom of the chassis, the winding disk receiving a roll of plastic film wound thereon in such a way that an end of the plastic film is unwindable from the winding disk;

a tension regulation arm, which has two ends respectively provided with an axle and at least one pair of rotation axles, the axle having an end rotatably mounted to one side of the connection section at the bottom of the chassis so as to enable the tension regulation arm to swing up and down with the axle as a rotation axis, the rotation axles at one end of the tension regulation arm forming a gap therebetween; and a rotation shaft set, which is mounted to one side of the connection surface of the connection seat at the bottom of the conveyer device, the rotation shaft set comprising rotation shafts that form a plurality of gaps therebetween, the gaps and the gap that is formed between the rotation axles at one end of the tension regulation arm respectively receiving an end of the plastic film from the winding disk to extend therethrough and wind around the rotation axles at one end of the tension regulation arm and the rotation shafts of the rotation shaft set to have the end of the plastic film finally extend out through one of the gaps of the rotation shaft set to be subsequently received into the guide hole in the connection surface of the connection seat at the bottom of the conveyer device.

6. The plastic film wrapping device as claimed in claim 5, wherein the chassis having front and rear ends each being provided with a support section, the conveyer device being mounted on the two support sections.

7. The plastic film wrapping device as claimed in claim 6, wherein at least one connection section is arranged at the bottom of the chassis between the support sections.

8. The plastic film wrapping device as claimed in claim 5, wherein, the conveyer device forms a plurality of spaced receptacle zones, each of which is adapted to receive one of the articles-to-be-packaged therein.

9. A plastic film wrapping device, comprising:

a chassis;

at least one conveyer device, which is mounted on the chassis and is adapted to convey a plurality of articles-to-be-packaged;

at least one pair of feeders, which are respectively coupled to two sides of the chassis, each of the feeders comprising a roll of plastic film wound thereon in order to supply plastic films from the two sides of the chassis; and at least one enclosing device, which straddles between opposite sides of the conveyer device, the enclosing device comprising at least one pair of sealing blades that are reciprocally movable inward and outward in horizontal direction, the sealing blades forming therebetween a film sealing opening, whereby the inward movement of the two sealing blades into the film sealing opening make them combined with each other to fuse and joint together ends of the plastic films supplied from the two sides of the chassis by the two feeders in the film sealing opening and when a leading edge of one of the articles-to-be-packaged on the conveyor device passes through the film sealing opening between the two sealing blades, the leading edge of the article-to-be-packaged contacts and pulls forward the jointed plastic films to have the plastic films wrapped around an outer circumference of the article-to-be-packaged and then rear ends of the plastic films are fused to seal around the article-to-be-packaged by re-combination of the two sealing blades moved into the film sealing opening, so that the outer circumference of the article-to-be-packaged is wrapped and enclosed by the plastic films;

wherein the conveyer device comprises a connection seat arranged at a bottom thereof, the connection seat having two sides each forming a connection surface, the enclosing device comprising:

at least two pairs of support frame assemblies, which each have an end connected to the connection surface of each side of the connection seat at the bottom of the conveyer device, each of the support frame assemblies having a middle section that is provided with a guide seat, the guide seat forming at least one through hole to receive an end of a plastic film supplied from the feeder;

a base, which has a bottom having two sides each connected between ends of each pair of the support frame assemblies, the bottom of the base being provided, at each side thereof, with a direction changer, which allows the end of the plastic film that extends through the through hole of the guide seat of the support frame assemblies to wind around the direction changer to make a 90-degree turn so as to be changed from outside the ends of the base into inside the base, the base having a surface forming a first elongate slot and a second elongate slot;

a rail unit, which is mounted atop the base, the rail unit comprising at least one pair of first screw rod and second screw rod, at least one pair of first rail and second rail, at least one pair of movable seats, and at least one pair of first ancillary rail and second ancillary rail, wherein the first screw rod and the first rail and the second screw rod and the second rail are arranged in pair in vertical arrangement, the first screw rod and the first rail being arranged in pair at the front side of the rail unit, the second screw rod and the second rail being arranged in pair at the rear side of the rail unit, the first screw rod having an end to which a first gear is mounted, the second screw rod having two ends to which a second gear and a transmission roller are respectively mounted, the second gear mating the first gear at one end of the first screw rod, whereby the first screw rod and the second screw rod are coupled to each other for rotation in opposite directions, the movable seats each having upper and lower ends respectively forming a threaded hole and a hole that respectively receive the paired first screw rod and first rail and the paired second screw rod and second rail to extend therethrough, whereby the two movable seats are driven by the clockwise or counterclockwise rotation of the first screw rod and the second screw rod to do linear movement toward outside or inside of the rail unit, the first ancillary rail being arranged above the first screw rod, the second ancillary rail being arranged above the second screw rod;

each of the sealing blades having a lower end forming a sealing section, the sealing sections respectively extending through the first elongate slot and the second elongate slot of the base, the sealing sections of the two sealing blades further forming therebetween the film sealing opening, the two sealing blades having upper ends respectively coupled to the two movable seats, whereby the two sealing blades are movable in unison with the movable seats to do linear movement along the first elongate slot and the second elongate slot of the base;

a driving motor, which is arranged above the first ancillary rail of the rail unit, the driving motor having a spindle coupled to a roller, the roller being coupled by a belt to the transmission roller at one end of the second screw rod of the rail unit, whereby the second screw rod of the rail unit is driven by clockwise or counterclockwise rotation of the spindle of the driving motor to rotate;

a first detection unit, which is arranged at one side of the conveyer device behind the enclosing device to detect a leading edge of an article-to-be-packaged conveyed by the conveyer device in order to activate the driving motor to output rotary power;

a second detection unit, which is mounted to the first ancillary rail of the rail unit to detect a preset maximum position of the moveable seat where the movable seat that is connected to the first screw rod and the first rail moves to at the inner side of the rail unit; and controls the driving motor to cut off the supply of rotary power in forward direction to the second screw rod of the rail unit and also have the driving motor to supply rotary power in an opposite direction to the second screw rod so as to prevent the two movable seats from further movement to the inner side of the rail unit and instead, moving toward an outer side of the rail unit; and at least one pair of third detection units, which are mounted to one end portion of the first ancillary rails of the rail unit to detect the maximum position of the movable seat that is connected to the first screw rod and the first rail moving toward the outer side of the rail unit, whereby when the movable seat reaches a preset outer maximum position of the rail unit set by the two third detection units, the driving motor is controlled to cut off the supply of rotary power to the second screw rod of the rail unit to have the two movable seats stopping at the outer maximum position of the rail unit.

10. The plastic film wrapping device as claimed in claim 9, wherein a controller is arranged above the rail unit of the enclosing device, the controller being provided to integrate the operations of detection and control of the first detection unit, the second detection unit and the third detection units and the driving motor of the enclosing device.

11. The plastic film wrapping device as claimed in claim 9, wherein the chassis having front and rear ends each being provided with a support section, the conveyer device being mounted on the two support sections.

12. The plastic film wrapping device as claimed in claim 11, wherein at least one connection section is arranged at the bottom of the chassis between the support sections.

13. The plastic film wrapping device as claimed in claim 9, wherein, the conveyer device forms a plurality of spaced receptacle zones, each of which is adapted to receive one of the articles-to-be-packaged therein.

* * * * *